US008241506B1

(12) United States Patent
Vernier et al.

(10) Patent No.: US 8,241,506 B1
(45) Date of Patent: Aug. 14, 2012

(54) FLOATING DEBRIS REMOVAL SYSTEM FOR A POOL

(75) Inventors: Paul Vernier, Peoria, AZ (US); William Vernier, Richardson, TX (US)

(73) Assignee: PB's Enterprises, Inc., Richardson, TX (US)

( * ) Notice: Subject to any disclaimer, the term of this patent is extended or adjusted under 35 U.S.C. 154(b) by 0 days.

(21) Appl. No.: 12/947,843

(22) Filed: Nov. 17, 2010

Related U.S. Application Data

(60) Provisional application No. 61/401,642, filed on Aug. 17, 2010.

(51) Int. Cl.
*E04H 4/16* (2006.01)

(52) U.S. Cl. ..... 210/776; 210/783; 210/167.12; 210/167.19

(58) Field of Classification Search ..... 210/776, 210/783, 791, 167.1, 167.12, 167.19, 400, 210/408, 409
See application file for complete search history.

(56) References Cited

U.S. PATENT DOCUMENTS

| | | | | |
|---|---|---|---|---|
| 6,029,290 | A | 2/2000 | Butcher et al. | |
| 7,402,242 | B2 | 7/2008 | Duckett | |
| 2011/0215038 | A1 * | 9/2011 | Couturier et al. | 210/167.19 |

FOREIGN PATENT DOCUMENTS

JP 2010-69390 A * 4/2010

* cited by examiner

*Primary Examiner* — Fred Prince
(74) *Attorney, Agent, or Firm* — Michael Diaz

(57) ABSTRACT

A system and method for automatically removing debris from a surface of a pool. The apparatus for cleaning debris from a pool surface includes a support and a conveyor belt supported by the support. The conveyor belt is inclined and includes upper and lower ends. The conveyor belt is driven from the lower end to the upper end. A diverter is used for diverting debris from the pool surface to the lower end of the conveyor belt. The diverter is connected at the lower end of the support and configured to be positioned outside a skimmer opening of a pool. The apparatus is positioned at the skimmer opening to receive floating debris prior to entering the skimmer opening. The conveyor belt moves the floating debris to the upper end of the conveyor belt. The debris is then deposited into a receptacle.

20 Claims, 10 Drawing Sheets

FLOATING DEBRIS REMOVAL SYSTEM FOR A POOL

RELATED APPLICATIONS

This application claims the benefit of U.S. Provisional Patent Application Ser. No. 61/401,642 entitled "Novel, Portable Swimming Pool Floating Debris Removal System" filed on Aug. 17, 2010 under the names of Paul E. Vernier and William S. Vernier.

BACKGROUND OF THE INVENTION

1. Field of the Invention

This invention relates to pool equipment. Specifically, and not by way of limitation, the present invention relates to a floating debris removal system for a pool.

2. Description of the Related Art

Many homes include pools for the enjoyment of their occupants. Pools provide a refreshing way of enjoying the summer, provide a place to exercise and accentuate the backyard of many residences. However, as most homeowners having pools know, the upkeep and cleaning of a pool can take a large amount of a person's time. In particular, the cleaning of a pool and removal of debris from skimmer baskets is both time consuming and tedious. However, neglecting the cleaning of the pool including the removal of debris from the surface of a pool can have dire consequences to the equipment and overall condition of the pool.

To maintain a clean pool, most swimming pools have the water filtered by a two stage filtration system. The first stage utilizes a skimmer assembly having an inlet and basket with apertures. The pool water flows into the top of the basket and out through the bottom of the basket. The basket is specifically designed to remove large debris, such as leaves, blossoms, and large bugs which may have fallen into the water. The water exiting the skimmer basket is then generally pumped to a second stage filter. The second stage filter typically is a sand or diatomaceous earth filter that removes fine debris which passes through the skimmer system. However, over time, if the basket is not emptied, the basket may become clogged with debris and impede the passage of the water through the basket. This condition may cause damage to the components of the second stage filter, such as the pump and the entire filter system. Thus, it is imperative that the basket be emptied and replaced on a regular basis. Furthermore, this problem is aggravated when the vegetation near a pool matures, particularly trees, which results in an increased amount of debris. Historically, this growth occurs slowly and the pool owner spends an incrementally higher amount of time handling this problem. Eventually, this may result in an inordinate amount of time and effort being required by the pool owner to attend to the skimmer basket when the amount of debris is very large.

A system is needed for negating the constant care necessary in emptying the skimmer baskets. In particular, a system is needed to automatically remove debris from the pool surface. Although there are no known prior art teachings of a system or method such as that disclosed herein, prior art references that discuss subject matter that bears some relation to matters discussed herein are U.S. Pat. No. 6,029,290 to Butcher et al. (Butcher) and U.S. Pat. No. 7,402,242 to Duckett (Duckett).

Butcher discloses a pool skimmer cleaner. The pool skimmer cleaner includes a conveyor belt which removes debris. The lower end of the conveyor belt is inserted into the skimmer below the level of the water. As the conveyor belt is rotated, the belt removes debris from the skimmer to a point outside the skimmer where the conveyor belt deposits the debris into a receptacle. However, Butcher suffers from several disadvantages. The conveyor belt of Butcher is designed to be inserted into the top of the skimmer which may impede the flow of water in the swimming pool skimmer, thereby reducing the efficiency of the skimmer system. Furthermore, because of its bulk and configuration, the skimmer cleaner is not portable. In addition, Butcher requires the debris to enter through the skimmer opening, which makes it difficult for the skimmer cleaner to sufficiently remove all debris on the pool's surface.

Duckett discloses a debris removal skimmer for a swimming pool. The skimmer includes a rectangular enclosure having an inlet opening coupled to a flow control door or flapper. The skimmer further includes a conveyor assembly which has a pair of cylinders around which is disposed a conveyor belt. The first cylinder is located at the top side opposite the inlet opening. The second cylinder is located near the inlet opening which is located under the water level when the skimmer is installed. One of the cylinders is motorized so that when a piece of debris is carried by the water through the inlet opening, it is pushed against the conveyor belt. The piece of debris is then carried by the belt up towards the top of the enclosure and ultimately outside the enclosure. However, Duckett also suffers from several disadvantages. First, Duckett is not portable and must be built into the skimmer. Furthermore, Duckett requires the use of an enclosure, which adds considerable cost to the skimmer system.

Therefore, it would be advantageous to have a system which automatically removes debris from the surface of a pool which is portable and useable on an existing pool. It is an object of the present invention to provide such a system.

SUMMARY OF THE INVENTION

The present invention is a system and method for automatically removing debris from a surface of a pool. The present invention is configured to be positioned ahead of a skimmer opening located at an edge of the pool. In one aspect, the present invention is directed to an apparatus for cleaning debris from a pool surface. The apparatus includes a support and a conveyor belt supported by the support. The conveyor belt is inclined and includes upper and lower ends. The conveyor belt is driven from the lower end to the upper end. A diverter is used for diverting debris from the pool surface to the lower end of the conveyor belt. The diverter is connected at a lower end of the support and configured to be positioned outside a skimmer opening of a pool. The apparatus is positioned at the skimmer opening to receive debris prior to entering the skimmer opening. The conveyor belt moves the debris to the upper end of the conveyor belt.

In another aspect, the present invention is a system for cleaning debris from a pool surface. The system includes a skimmer having a skimmer opening which is located on an edge of a pool. The system also includes a skimmer cleaning apparatus. The apparatus includes a support and a conveyor belt supported by the support. The conveyor belt is inclined and includes upper and lower ends. The conveyor belt is driven from the lower end to the upper end. A diverter for diverting debris from the pool surface to the lower end of the conveyor belt is attached to a lower end of the support and is configured to be positioned outside a skimmer opening of a pool. The apparatus is positioned at the skimmer opening to receive debris prior to entering the skimmer opening. The conveyor belt moves the debris to the upper end of the conveyor belt.

In another aspect, the present invention, is a method of cleaning debris from a pool surface having a skimmer opening. The method begins by positioning an apparatus having a diverter and an inclined conveyor belt in front of a skimmer opening. Next, the conveyor belt is continually driven from a lower end contacting the pool surface to an upper end of the conveyor belt. Debris is then collected prior to entering the skimmer opening. The debris is moved from the lower end to the upper end of the conveyor belt and deposited into a receptacle adjacent to the upper end.

DESCRIPTION OF THE INVENTION

Figure 1:
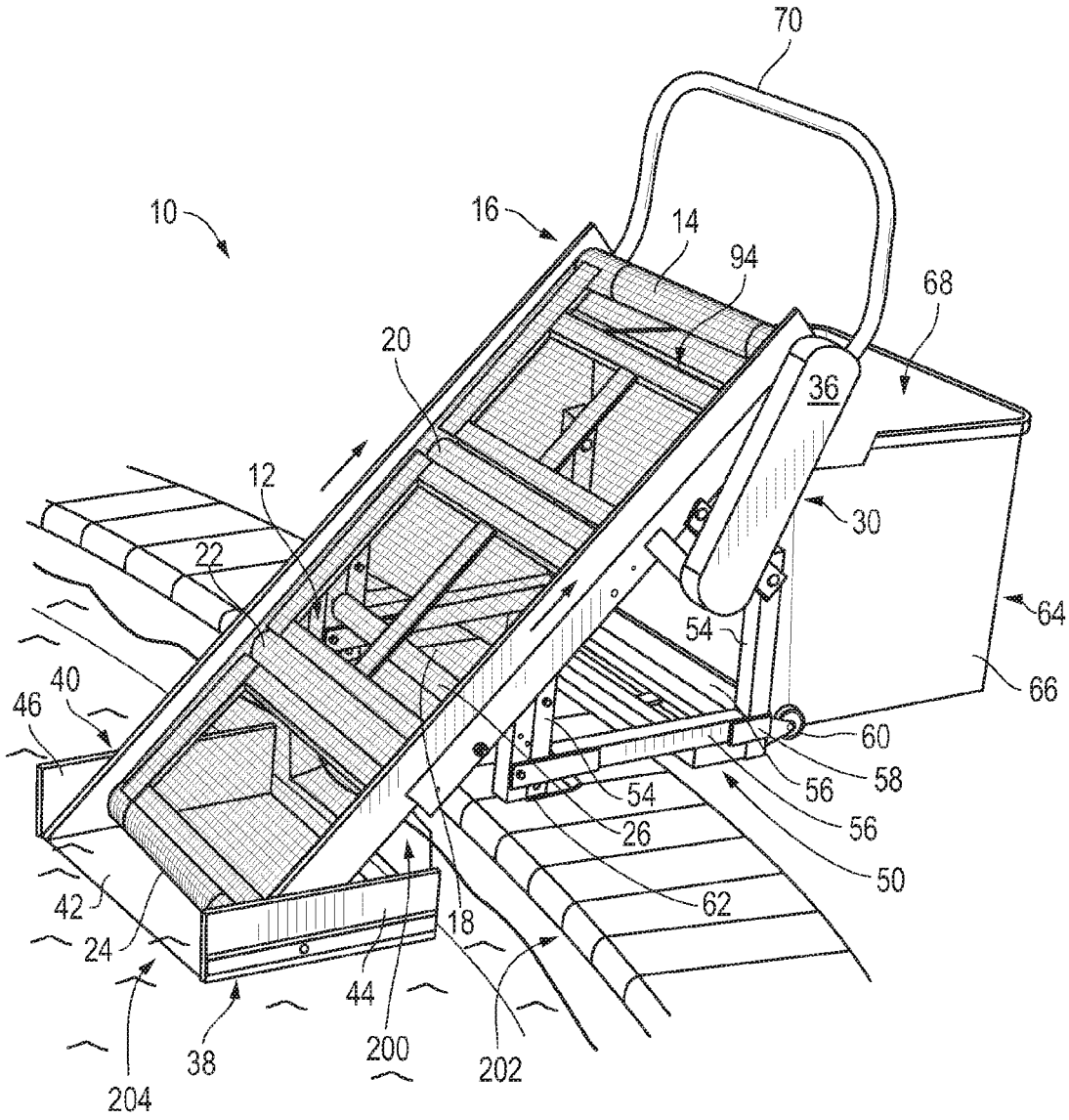
FIG. 1 is a front perspective view of a debris removal apparatus positioned at a skimmer opening located at a pool wall edge in the preferred embodiment of the present invention.

The present invention relates to a system for removing debris from the surface of a pool. FIG. 1 is a front perspective view of a debris removal apparatus 10 positioned at a skimmer opening 200 located at a pool wall edge 202 in the preferred embodiment of the present invention. The apparatus includes a conveyor belt 12 [belt this refers to the net and not the support or assembly]. The conveyor belt 12 is preferably positioned on an incline and constructed of a porous material such as a net material to allow water to pass through the conveyor belt. However, the conveyor belt may be constructed of any flexible material, such as fabric or plastic. The conveyor belt 12 is driven by a top drive roller 14 located on an upper end 16 of the inclined surface of the apparatus. Additionally, an upper level 18 of the conveyor belt is positioned over three idler rollers 20, 22, and 24. The conveyor belt, at a lower level 28 (see FIG. 8), is positioned above an underside roller 26 and below the idler rollers 20, 22, and 24.

The top drive roller 14 is driven by a drive system 30. The drive system preferably includes an electric motor 32 powered by a rechargeable battery 34 (preferably a rechargeable sealed lead acid 12 volt battery). In other embodiments, any device providing power to the drive system may be utilized, such as a gas motor. As depicted in FIG. 1, a cover 36 covers the drive system 30. At the bottom end 40 of the conveyor belt 12 is a diverter 38 having a planar section 42 and two sideboards 44 and 46.

Figure 9:
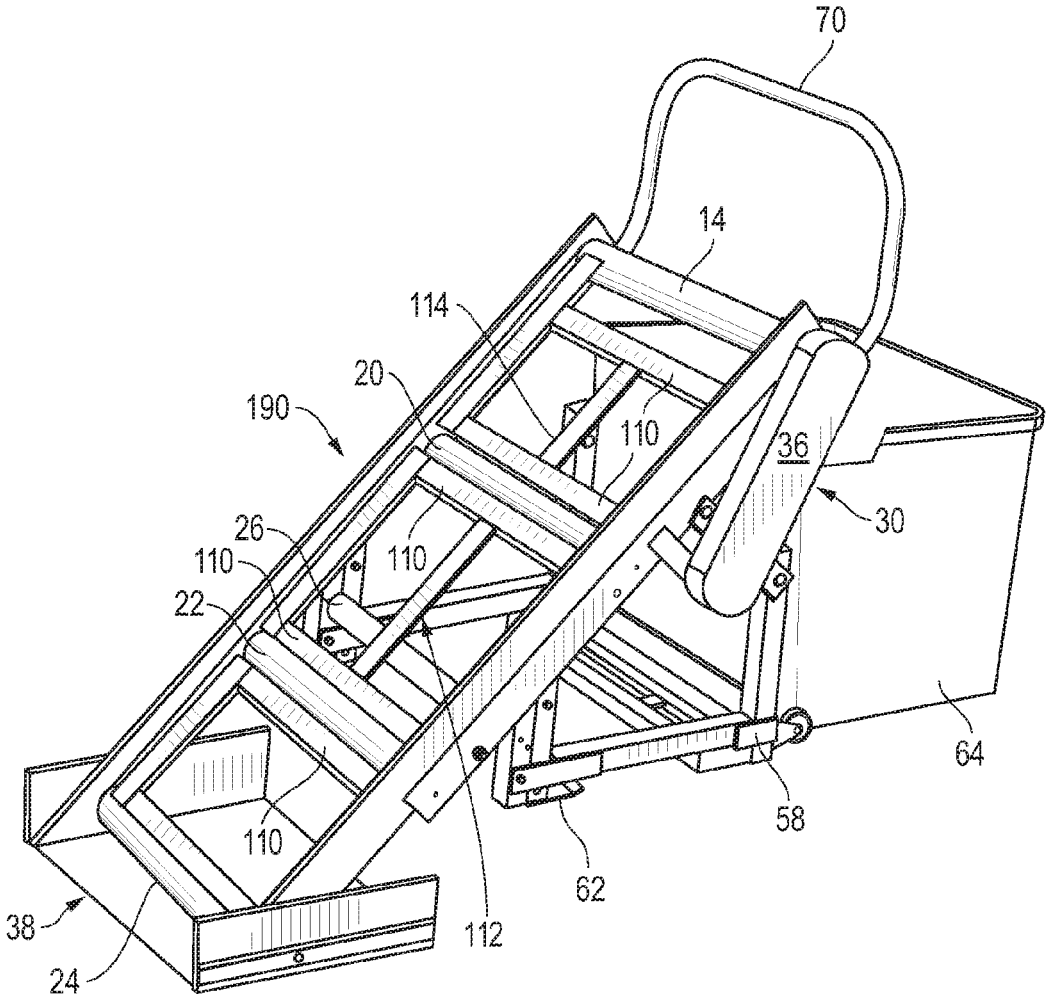
FIG. 9 is a front perspective view of the debris removal apparatus with the net conveyor belt removed.

The conveyor belt 12 is supported by a support assembly 190 having a truss assembly 110 and longitudinal supports 112 and 114 (see FIG. 9). The support assembly, conveyor belt 12, drive roller 14, idler rollers 20, 22, and 24, and underside roller 26 all rest on a frame 50 having a plurality of vertical support structures 54 and horizontal support structures 56. [This added section includes a support assembly 190 which includes the truss assembly 110 and longitudinal supports 112 and 114] The frame 50 and the support assembly 190 function as a support for the conveyor belt. It should be understood that any support configuration may be used which supports and allows the conveyor belt to move from a low end to the high end and still remain in the scope of the present invention. Wheels 60 may be located at junctions 58. In addition, the frame may include retractable footrests 62 (shown retracted in FIG. 1). The vertical and horizontal support structures and the footrests may be constructed of any rigid material, such as steel, plastics or any type of composite material capable of supporting the components of the apparatus 10.

A receptacle 64 is located adjacent to the apparatus 10. In the preferred embodiment, the receptacle is rectangular in shape having side walls 66 and an upper opening 68. Furthermore, a bottom surface (not shown) of the receptacle may include a plurality of openings to allow water collecting in the receptacle to pass through the bottom of the receptacle and return back to the pool through the skimmer basket opening. The receptacle 64 may be constructed of any rigid material, such as plastic.

Figure 2:
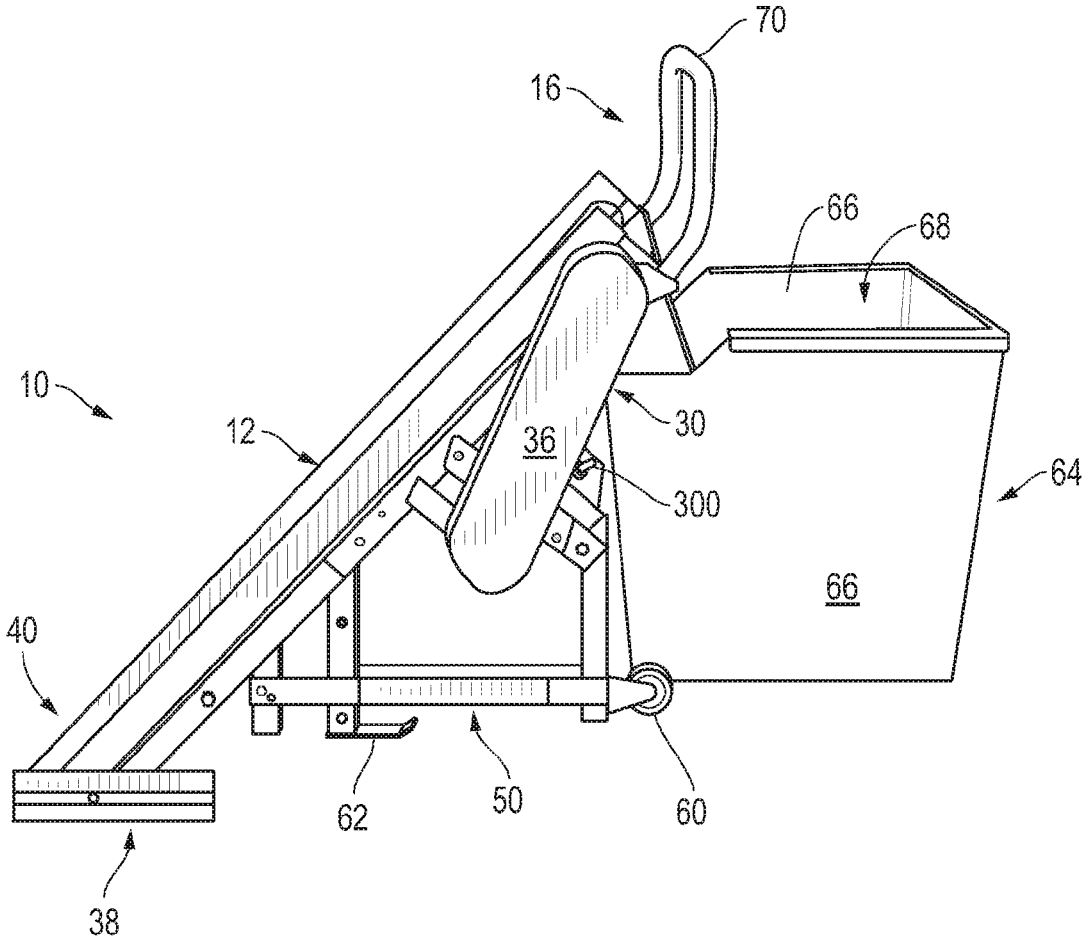
FIG. 2 is a right side view of the apparatus of FIG. 1.
Figure 3:
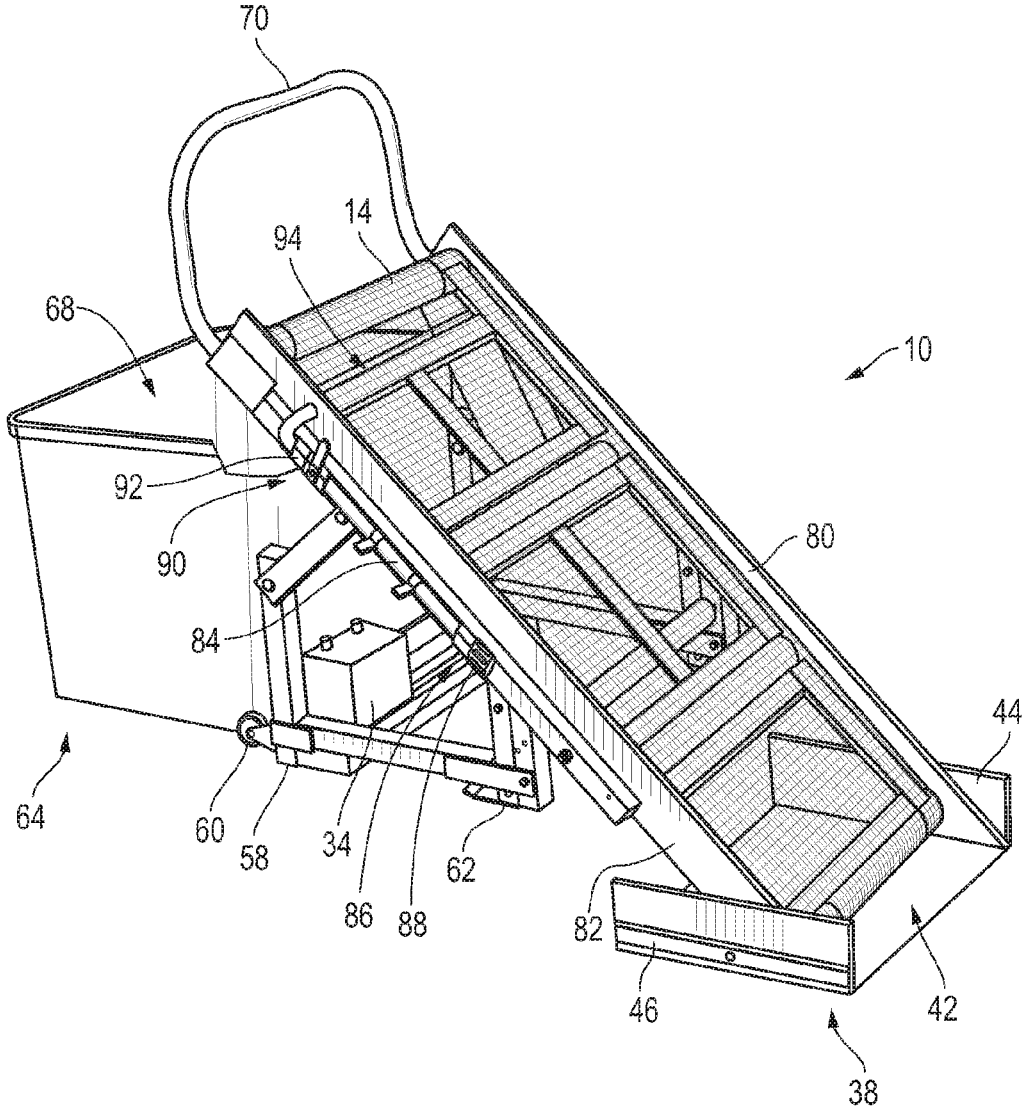
FIG. 3 is a left front perspective view of the apparatus.

FIG. 2 is a right side view of the apparatus 10 of FIG. 1. The apparatus 10 may also include a handle 70 located above the upper end 16 providing ease in moving the apparatus. FIG. 3 is a left front perspective view of the apparatus 10. The apparatus may include wheels 60 located at opposing junctions 58 on each lower rear portion of the frame 50. The wheels are preferably oriented horizontally and positioned where the wheels do not touch the ground when the apparatus is positioned forward over the skimmer. Additionally, a footrest 62 (shown retracted in FIGS. 2 and 3) may be located on the left side of the apparatus. A corresponding footrest 62 may be located on the right side of the apparatus. The apparatus includes inclined raised sides 80 and 82 to prevent debris carried upon the conveyor belt from falling over the sides of the conveyor. Upon the side 82 is preferably mounted a pipe 84. The pipe is a tubular structure having a bore allowing the flow of water through the pipe. At a lower end 86 of the pipe 84 is a threaded coupling device 88 for coupling to a hose (not shown). The threaded coupling device may be a threaded female or male end. On an upper end 90 of the pipe 84 is a shutoff handle 92 for shutting off the flow of water as desired by the user. The pipe is coupled to a unique spray system on the upper end 90. The spray system includes a spray rod 94. The spray rod 94 is positioned laterally adjacent and just below the drive roller 14. The spray rod has a bore for allowing the flow of water which exits a plurality of orifices running the length of the spray rod. The orifices allow water to spray up to the lower edge of the drive roller, which enables any debris which does not fall off the conveyor belt due to gravity to be blown off into the receptacle.

Figure 4:
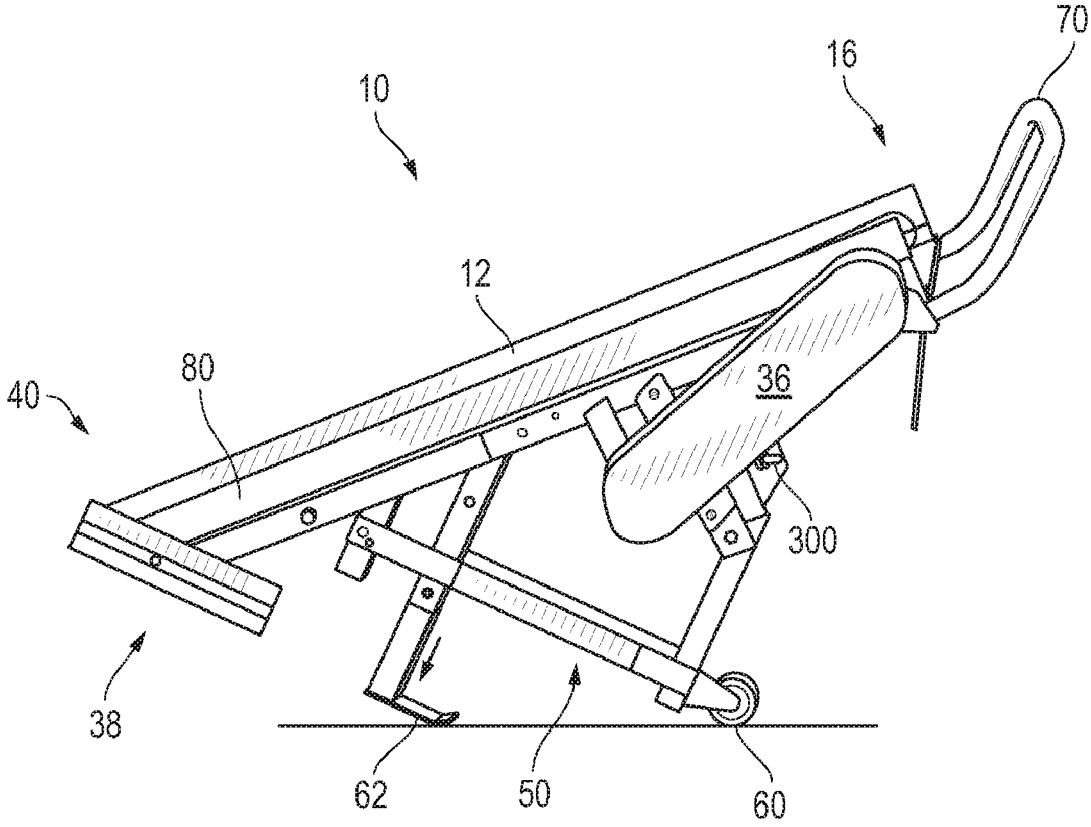
FIG. 4 is a right side view of the apparatus with the footrest extended.

FIG. 4 is a right side view of the apparatus 10 with the footrest 62 extended. With the footrest extended, the apparatus may be rotated back to where the wheels 60 are adjacent to the ground. With the footrests extended, the apparatus may be positioned out of the pool without damaging the diverter 38. To move the apparatus, the user may grasp the handle 70 and rotate the apparatus rearward to enable the wheels to contact the ground, thereby allowing the apparatus to be easily moved on the ground.

Figure 5:
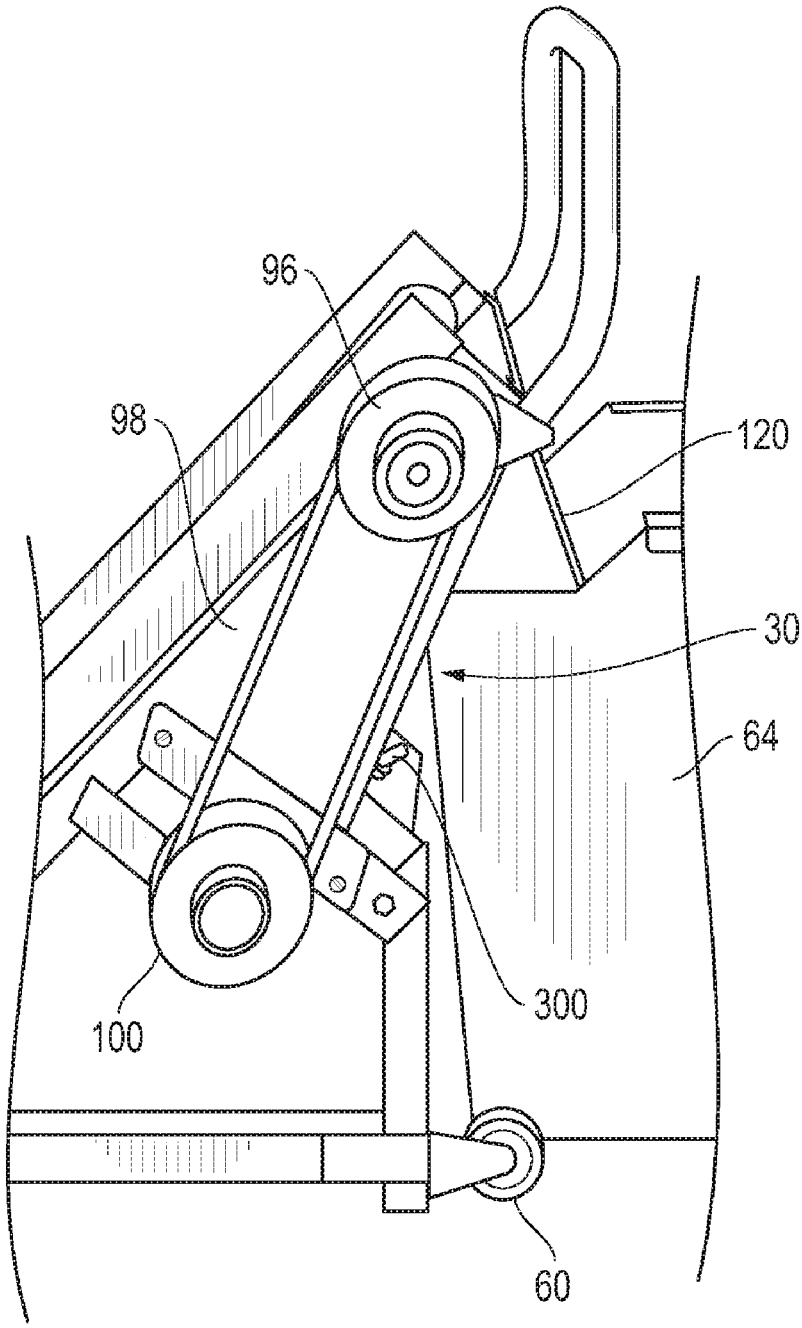
FIG. 5 is an enlarged side view of the drive system with the cover removed.

FIG. 5 is an enlarged side view of the drive system 30 with the cover 36 removed. In the preferred embodiment, the drive system includes a 3 inch OD ½ ID pulley 96 having an adjustable diameter, a V-belt 98, and a 3 inch OD ½ ID pulley 100 connected to the motor. Preferably, the adjustable diameter pulley is a variable speed pulley in which the diameter of the pulley may be adjusted to compensate for a sagging belt.

In other embodiments, the drive system may be a chain drive system or a geared drive system. Any drive system may be used which enables the drive roller 14 to be rotated.

Figure 6:
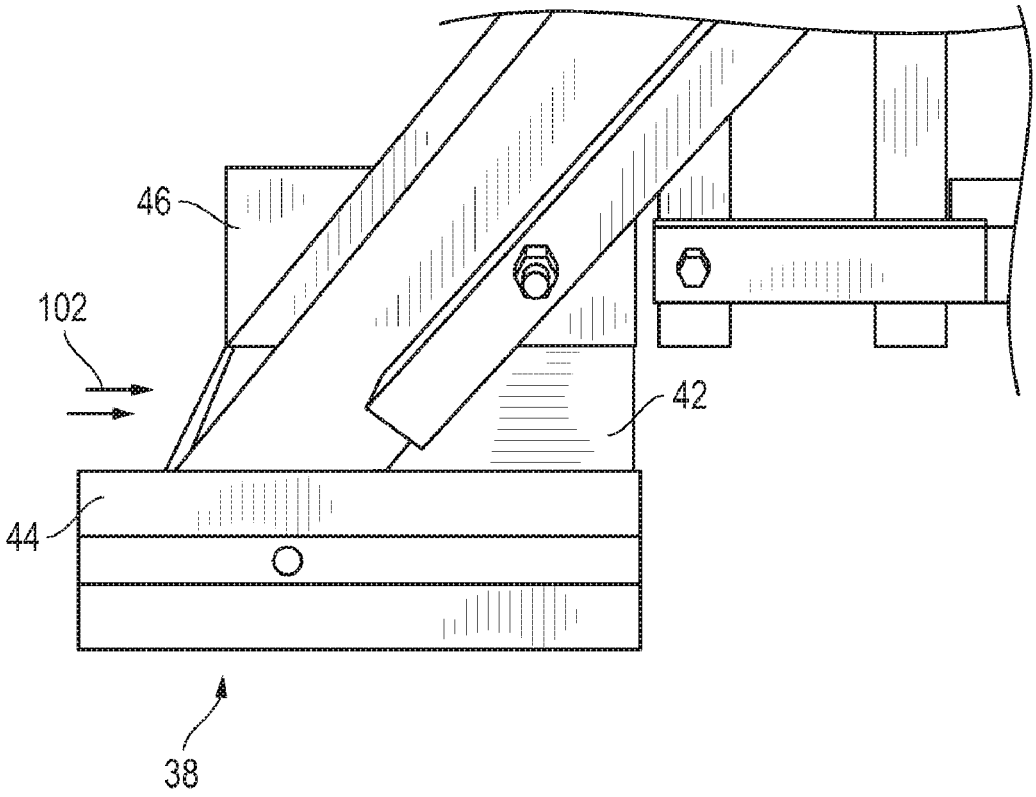
FIG. 6 is an enlarged side view of the diverter.
Figure 7:
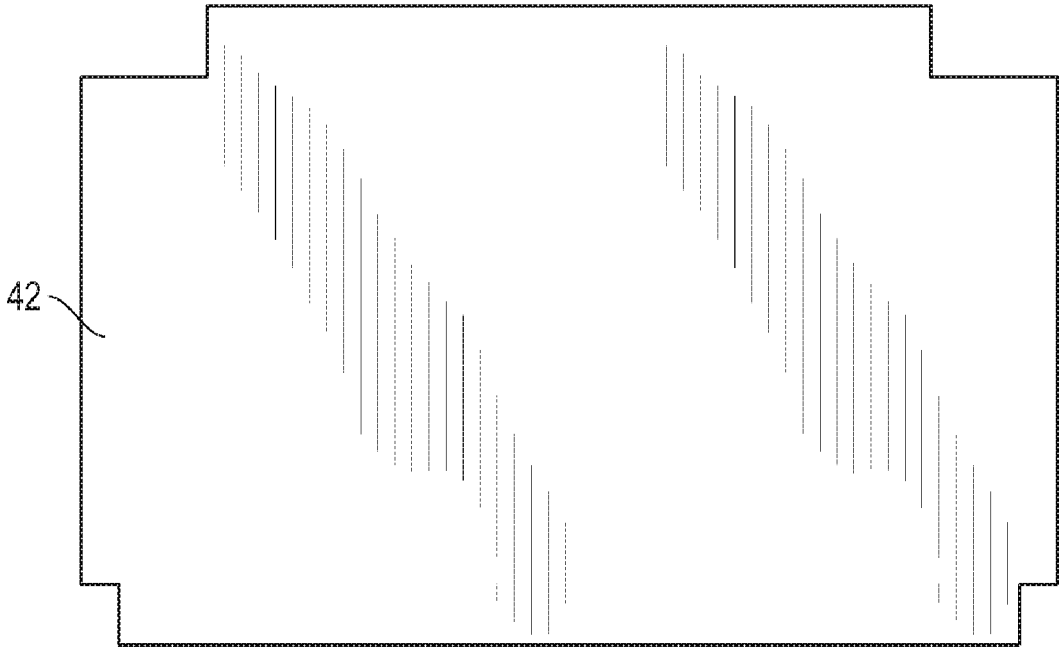
FIG. 7 is a bottom view of the diverter.

FIG. 6 is an enlarged side view of the diverter 38. The diverter 38 includes a planar section 42 and sideboards 44 and 46. Water flow 102 flows as depicted in FIG. 6. FIG. 7 is a bottom view of the planar section 42. The planar section is sized and shaped to lie adjacent to the lower edge of the skimmer opening. The diverter may be attached at pivot points along the sides 80 and 82, thereby allowing the diverter to rotate or pivot about the pivot points freely. The diverter preferably runs the width of the conveyor belt. The diverter, in conjunction with the skimmer opening, constricts the flow of water entering the skimmer, thereby creating a Venturi Effect. According to the laws governing fluid dynamics, a fluid's velocity must increase as it passes through a constriction to satisfy the conservation of mass while its pressure must decrease. This phenomenon is known as the Venturi Effect. By using this configuration of the diverter, water is accelerated as it passes through the diverter, which assists in collecting the debris onto the bottom of the conveyor belt.

Figure 8:
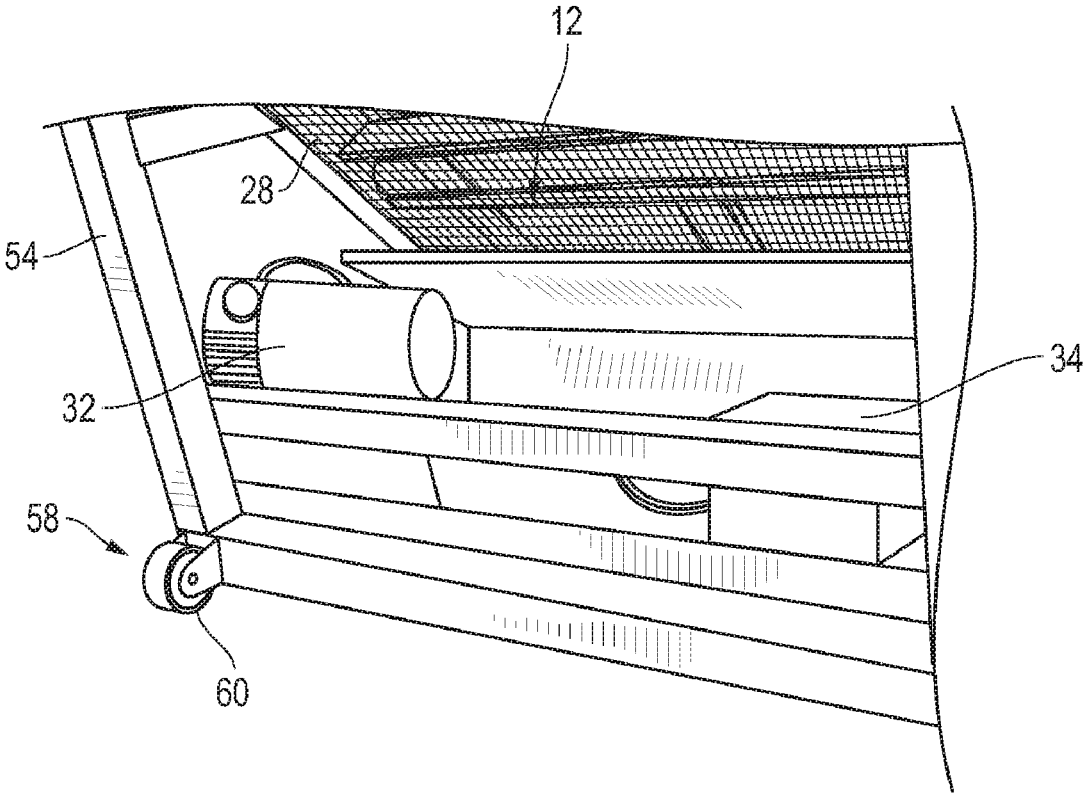
FIG. 8 is a rear view of a lower portion of the apparatus.

FIG. 8 is a rear view of a lower portion of the apparatus 10. FIG. 8 depicts the lower level 28 of the conveyor belt 12. In addition, the battery 34 is easily accessible for recharging. In one embodiment, the battery may include a cable to enable recharging from a recharging unit without removing the battery from the apparatus 10. The battery is used to provide power to the electric motor. The electric motor may also be affixed to the frame 50. The electric motor is coupled to the drive system 30 to rotate the drive roller 14.

FIG. 9 is a front perspective view of the debris removal apparatus 10 with the conveyor belt 12 removed. The apparatus may also include the truss assembly 110 for supporting the drive roller 14, the idler rollers 20, 22, and 24, and the underside idler roller 26. In addition, longitudinal supports 112 and 114 may provide additional structural support. The longitudinal supports and the truss assembly are preferably constructed of a light rigid material capable of providing support to the apparatus, such a plastic or composite material.

Figure 10:
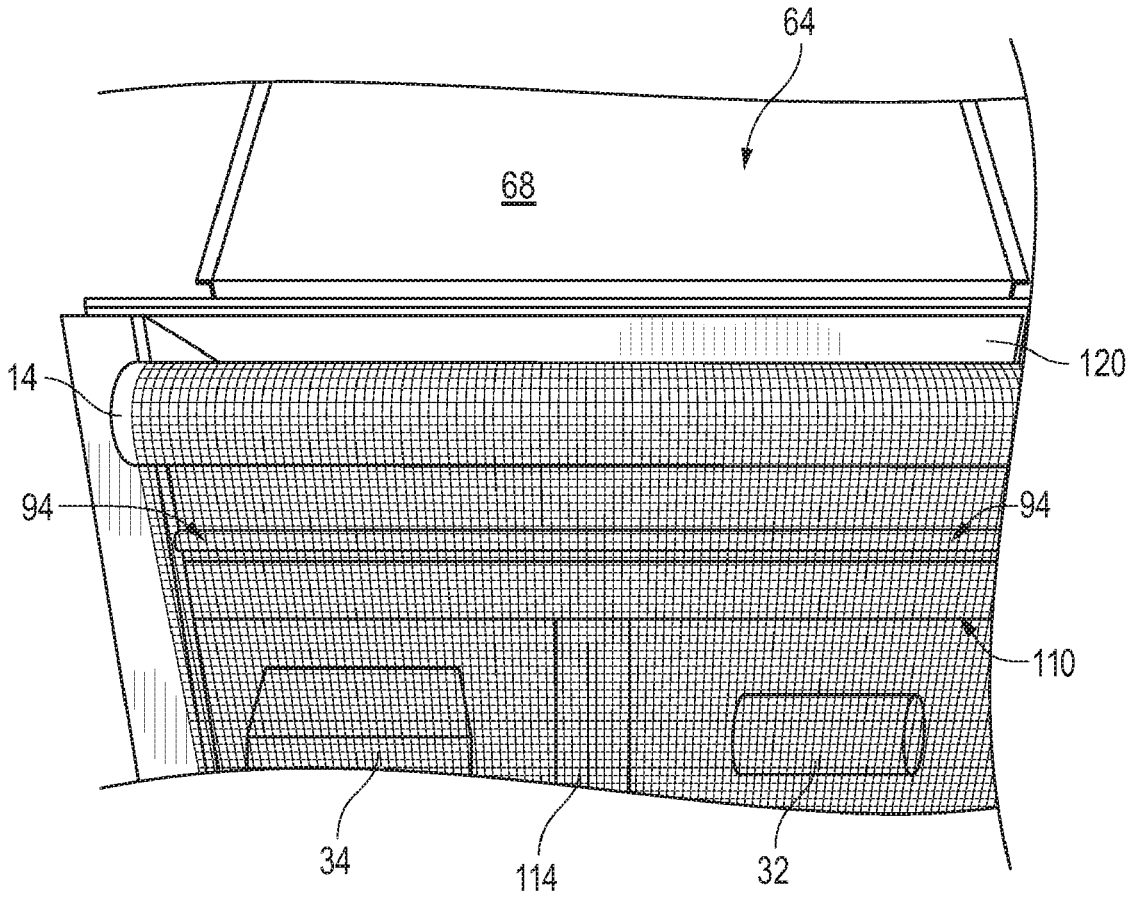
FIG. 10 is an enlarged front view of the upper end of the conveyor belt.

FIG. 10 is an enlarged front view of the upper end 16 of the conveyor belt 12. The spray rod 94 includes a plurality of orifices (not shown) located along its length. Water is directed through the orifices to spray against a lower edge of the drive roller 14. An optional apron 120 may be used to direct the debris into the upper opening 68 of the receptacle 64.

With reference to FIGS. 1-10, the operation of the debris removal apparatus 10 will now be explained. The apparatus 10 is positioned in front of the skimmer opening 200. The planar section 42 of the diverter is located below a water edge 204, adjacent to the bottom of the skimmer opening. Preferably, the sideboards 44 and 46 are located at each side edge of the skimmer opening. The user actuates a power switch 300 to provide power from the battery 34 to the electric motor 32. The battery 34 may be recharged as necessary to provide a sufficient charge to the battery. In one embodiment, the battery includes a cable which may be attached to a recharging unit (not show) without removing the battery from the apparatus 10. The motor then provides power to the drive system for driving the drive roller.

The drive system includes the adjustable diameter pulley 96, a belt 98, and a motor pulley 100. In one embodiment, the adjustable diameter pulley may be adjusted as necessary to keep the pulley taut. The drive system is driven by the electric motor 32. The conveyor belt moves in an upper direction by the drive roller which receives power through the drive system from the motor. As the conveyor belt moves, the upper level 18 of the conveyor belt contacts the idler rollers 20, 22, and 24. Additionally, the underside idler roller 26 supports a lower surface of the lower level 28 of the conveyor belt. The idler rollers and underside idler roller are preferably all free rolling and utilized to support the conveyor belt as it moves.

In one embodiment, a hose is connected to the threaded coupling device 88. The shutoff valve may be used to cut off water to the spray rod 94 as necessary. Water may be supplied through the hose and pipe 84 to the spray rod 94 where water is sprayed out the plurality of orifices of the spray rod toward a bottom of the drive roller 14. By applying water at the lower part of the drive roller 14, any debris which is stuck on the net conveyor belt is removed and falls into the receptacle 64 through the upper opening 68. The apron 120 may be optionally used to help direct the debris into the receptacle and divert the water spraying from the spray rod 94 back into the pool.

As depicted in FIG. 6, the water flow 102 from the pool runs over the planar 42. Because of the configuration of the sideboards of the diverter 38, a Venturi effect is established by which the water flow is further accelerated through the middle of the planar section to assist in driving floating debris toward the bottom end 40 of the convey belt. Furthermore, the water flows into the skimmer opening because of the pumping of water sucking the water into the filtration system of the pool. Thus, the debris moves toward the skimmer opening. The debris is then received on an upper surface of the conveyor belt and carried upwardly where it is deposited into the receptacle 64.

When not in use, the apparatus may be removed from the pool. The footrest 62 may be extended and the apparatus rotated clockwise as depicted in FIG. 4. The wheels 60 may contact the ground and be used to roll the apparatus as necessary to a desired location.

In one embodiment, the frame 50 may be collapsed to a smaller dimension allowing for ease in storage of the apparatus 10. Additionally, any motor device may be used to drive the conveyor belt. Furthermore, the present invention may utilize any configuration of rollers, supports and frames to enable an inclined moving conveyor belt to capture debris from a pool's surface and still remain in the scope of the present invention.

With reference to FIGS. 1-10, a method of using the apparatus 10 will now be explained. The method begins by positioning the apparatus 10. Next, the conveyor belt is continuously driven from the lower end below the pool surface to the upper end of the conveyor belt. Debris is then collected prior to entering the skimmer opening. The debris is moved from the lower end to the upper end of the conveyor belt and deposited into a receptacle adjacent to the upper end.

The present invention provides many advantages over existing pool cleaning devices. The present invention provides a cost-effective and simple apparatus for cleaning floating debris from the surface of a pool. The present invention may be used on existing pools without any modification to pool equipment. Furthermore, the present invention provides a novel way of collecting the debris prior to entry into the skimmer opening, which prevents debris from collecting into the skimmer baskets. In addition, the present invention is easily transportable providing wheels and footrests to enable ease in maneuvering the apparatus as desired by the user. In addition, by utilizing adjustable pulleys, the present invention can compensate for any pulley belts in the drive system from stretching.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An apparatus for cleaning debris from a pool surface, the apparatus comprising:

a support;

a conveyor belt supported by the support, the conveyor belt being inclined and having an upper end and a lower end;

means for driving the conveyor belt for moving the conveyor belt from the lower end to the upper end; and a diverter for diverting debris from the pool surface to the lower end of the conveyor belt, the diverter connected at a lower end of the support and configured to be positioned outside a skimmer opening of a pool;

whereby the apparatus is positioned at the skimmer opening to receive debris prior to entering the skimmer opening and the conveyor belt moves the debris to the upper end of the conveyor belt.

2. The apparatus according to claim 1 wherein the means for driving the conveyor belt is a motor attached to a drive roller for pulling the conveyor belt.

3. The apparatus according to claim 2 wherein the motor is electric and is powered by a rechargeable battery.

4. The apparatus according to claim 1 wherein the means for driving the conveyor belt includes at least one variable pulley and a belt attached to a drive roller for pulling the conveyor belt.

5. The apparatus according to claim 1 wherein the support includes a frame having wheels attached to a bottom portion of the frame for transporting the apparatus.

6. The apparatus according to claim 5 wherein in the frame includes retractable footrests for storing the apparatus on the ground.

7. The apparatus according to claim 1 wherein the diverter includes a planar section adapted for lying adjacent to a lower edge of the skimmer opening.

8. The apparatus according to claim 7 wherein the planar section includes raised sideboards.

9. The apparatus according to claim 8 wherein the planar section is pivotable.

10. The apparatus according to claim 1 further comprising a receptacle having an upper opening, wherein the receptacle is positioned adjacent to the upper end of the conveyor belt for collecting debris collected by the conveyor belt.

11. The apparatus according to claim 10 wherein the receptacle includes holes located at a bottom side of the receptacle to allow water to flow out the bottom side of the receptacle.

12. The apparatus according to claim 1 further comprising an apron located at the upper end of the conveyor belt.

13. The apparatus according to claim 1 wherein the conveyor belt is water porous.

14. The apparatus according to claim 1 further comprising a spray rod located at the upper end of the conveyor belt for spraying water on the conveyor belt to remove debris from the conveyor belt.

15. A system for cleaning debris from a pool surface, the system comprising:

a skimmer having a skimmer opening, the skimmer located on an edge of a pool; and a skimmer cleaning apparatus, the apparatus comprising:

a support;

a conveyor belt supported by the support, the conveyor belt being inclined and having an upper end and a lower end;

means for driving the conveyor belt for moving the conveyor belt from the lower end to the upper end; and a diverter for diverting debris from the pool surface to the lower end of the conveyor belt, the diverter connected at a lower end of the support and configured to be positioned outside a skimmer opening of a pool;

whereby the apparatus is positioned at the skimmer opening to receive debris prior to entering the skimmer opening and the conveyor belt moves the debris to the upper end of the conveyor belt.

16. The system according to claim 15 wherein the diverter includes a planar section adapted for lying adjacent to a lower edge of the skimmer opening.

17. The system according to claim 15 wherein the apparatus includes a receptacle having an upper opening, wherein the receptacle is positioned adjacent to the upper end of the conveyor belt for collecting debris collected by the conveyor belt.

18. The system according to claim 15 wherein the apparatus includes a spray rod located at the upper end of the conveyor belt for spraying water on the conveyor belt to remove debris from the conveyor belt.

19. A method of cleaning debris from a pool surface having a skimmer opening, the method comprising the steps of:

positioning an apparatus having a diverter and an inclined conveyor belt in front of a skimmer opening;

moving the conveyor belt from a lower end below the pool surface to an upper end of the conveyor belt;

collecting debris prior to entering the skimmer opening;

moving the debris from the lower end to the upper end of the conveyor belt; and depositing the collected debris into a receptacle adjacent to the upper end.

20. The method according to claim 19 further comprising the step of spraying water at the upper end of the conveyor belt to remove the debris from the conveyor belt.

* * * * *